US010041317B1

(12) United States Patent
Swinford

(10) Patent No.: US 10,041,317 B1
(45) Date of Patent: Aug. 7, 2018

(54) CIRCULATING TOOL FOR ASSISTING IN UPWARD EXPULSION OF DEBRIS DURING DRILLING

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 0 days.

(21) Appl. No.: 15/936,213

(22) Filed: Mar. 26, 2018

(51) Int. Cl.

| | |
|---|---|
| ***E21B 37/00*** | (2006.01) |
| ***E21B 21/10*** | (2006.01) |
| ***E21B 34/12*** | (2006.01) |
| *E21B 34/00* | (2006.01) |
| *E21B 41/00* | (2006.01) |

(52) U.S. Cl.
CPC ..... *E21B 21/103* (2013.01); *E21B 34/12* (2013.01); *E21B 41/0078* (2013.01); *E21B 2034/007* (2013.01)

(58) Field of Classification Search
CPC ..... E21B 37/00; E21B 37/04; E21B 41/0078
USPC ..... 166/222, 223; 175/316; 15/104.5, 15/104.09, 104.061
See application file for complete search history.

(56) References Cited

U.S. PATENT DOCUMENTS

| | | | | |
|---|---|---|---|---|
| 1,695,749 | A * | 12/1928 | Watson | E21B 37/08 116/DIG. 22 |
| 1,715,767 | A * | 6/1929 | Le Flore | E21B 17/14 166/223 |
| 4,967,841 | A * | 11/1990 | Murray | B08B 9/0433 134/22.12 |
| 6,173,771 | B1 * | 1/2001 | Eslinger | E21B 37/04 166/173 |
| 6,189,618 | B1 * | 2/2001 | Beeman | E21B 34/14 166/194 |
| 9,366,113 | B2 * | 6/2016 | Etschel | E21B 37/08 |
| 2010/0025042 | A1 * | 2/2010 | Tutuncu | E21B 21/103 166/312 |
| 2018/0066499 | A1 * | 3/2018 | Swinford | E21B 37/00 |

* cited by examiner

*Primary Examiner* — Kenneth L Thompson
(74) *Attorney, Agent, or Firm* — Eric P. Mirabel

(57) ABSTRACT

Disclosed is a circulating tool for aiding in removing debris from near the drill bit when drilling, especially for coiled tubing drilling operations. The drilling fluid entering the tool is directed to a sleeve which can spin freely around the tool, and includes upwardly directed ejection ports and tangentially oriented tangential ports. Fluid ejected from the tangential ports induce the sleeve to spin about the tool, and thus, fluid ejected from the ejection ports is spun to create a drilling fluid vortex within the well bore—and assist in carrying debris up and out.

20 Claims, 4 Drawing Sheets

CIRCULATING TOOL FOR ASSISTING IN UPWARD EXPULSION OF DEBRIS DURING DRILLING

FIELD OF INVENTION

This invention relates to assisting drilling of a well-bore by including a circulating tool actively propelling upward flow of debris.

BACKGROUND

Oil wells and natural gas are generally drilled into the earth and the underground oil or gas deposits are forced to the surface along the well bore by the underground pressure, or, pumped up using one or more pumps (often in a series). The well-bore is drilled from an oil-rig on the surface of earth using a rotating drilling bit. When the rotating drilling bit is driven into the earth, it cuts through layers of soil and rocks using a continuous flow of compressed drilling fluid (also known as "drilling mud") supplied through a conduit, which can be coiled tubing or a drill string (composed of a contiguous series of pipes). Drilling with coiled tubing necessitates use of a mud motor as part of the bottom hole assembly ("BHA"), for rotating the drilling bit. With a drill string, sometimes a mud motor is not included, as one can rotate the string itself to rotate the bit.

During drilling, hollow metallic tubes (also known as "casings") are inserted within the drilled bore to prevent the walls of bore from collapsing. In a deep enough bore, multiple hollow casings are installed vertically one above the other by screwing ends of adjacent sections with each other, thus forming a "bore casing." The well-bore within the bore casings should be kept clean (for proper functioning of tools and equipment), by efficiently removing rock debris, dirt and mud generated by drilling. Mud pumped down from the surface to the BHA, carries debris and dirt from the BHA upwardly inside the well-bore. But the pressurized mud alone may not be adequate to remove sufficient amounts of debris to clean the well-bore and provide a satisfactory operating environment for the tools and equipment therein.

Hence, there's need for a device which more effectively removes drilling debris from the well-bore and the region near the BHA.

SUMMARY

The invention is a circulating well-bore cleaning tool, primarily for use with coiled tubing. The tool is preferably connected adjacent and upstream of the BHA. The drilling fluid (mud) is pumped from the surface, and through the tool, and down to the BHA. Drilling fluid carrying debris from the BHA region, has its upward travel rate boosted by upward facing ejection ports (through which drilling fluid is ejected) in a sleeve, which fits snugly on the tool. The drilling fluid is pumped down at a rate (volume/time) greater than that which normally is handled by the BHA. The excess drilling fluid (per unit time) is ejected upwardly by the ejection ports, and also ejected by tangential ports in the sleeve, which cause the sleeve to spin and to create a drilling fluid vortex within the well bore.

The tool can include an internal valve along the internal bore, or another system to selectively or permanently occlude the bore at a point downstream of the ejection ports. The valve/occlusion will reduce the flow rate of drilling fluid to the BHA, and increase the flow rate through the ejection ports so as to either, or both: (i) protect the BHA from over-pressure; and (ii) increase the pressure at the ejection ports to carry more debris, or to carry debris more quickly, up and out.

The operating portions of the tool are, at the upper end, a substantially cylindrical mandrel with a central bore, having holes extending from the central bore through it. These holes align with the ejection ports and the tangential ports in a sleeve, having an ID designed to fit snugly on the OD of the portion of the mandrel with the holes. The valve or occlusion is downstream from the holes, preferably at the lower end of the mandrel. In a preferred embodiment, the tool includes additional portions downstream, such that the central bore connects to the central bore of a lower sub, which in turn is attached to tubing leading to, or directly to, connectors which are part of the BHA. All such additional downstream portions are fixed (directly or indirectly) with respect to the mandrel, so as not to rotate with the sleeve.

The tangential ports preferably have their outlets aiming substantially at a tangent to the outer surface of the sleeve. The tangential ports preferably are aligned substantially horizontally when the tool is in operation, i.e., transverse to the sleeve's longitudinal axis. The tangential ports may turn within the sleeve wall, so they are not straight, and may have a narrower inlet than the outlet. Thus, the tangential ports eject pressurized fluid from the bore substantially transverse to the tool's longitudinal axis and tangentially to the outer surface of the sleeve, to induce it to spin around the mandrel.

The ejection ports, as noted, preferably have their outlets facing upwardly when the tool is in operation. However, because they are formed by boring through wall of the sleeve, the ejection ports lie at an angle with respect to the sleeve's longitudinal access—and thus, are off the vertical when the tool is in operation. The ejection ports can be at any angle such that they force fluid up the well-bore.

Embodiments of the tool are discussed in greater detail with reference to the accompanying figures in the detailed description which follows.

Figure 1:
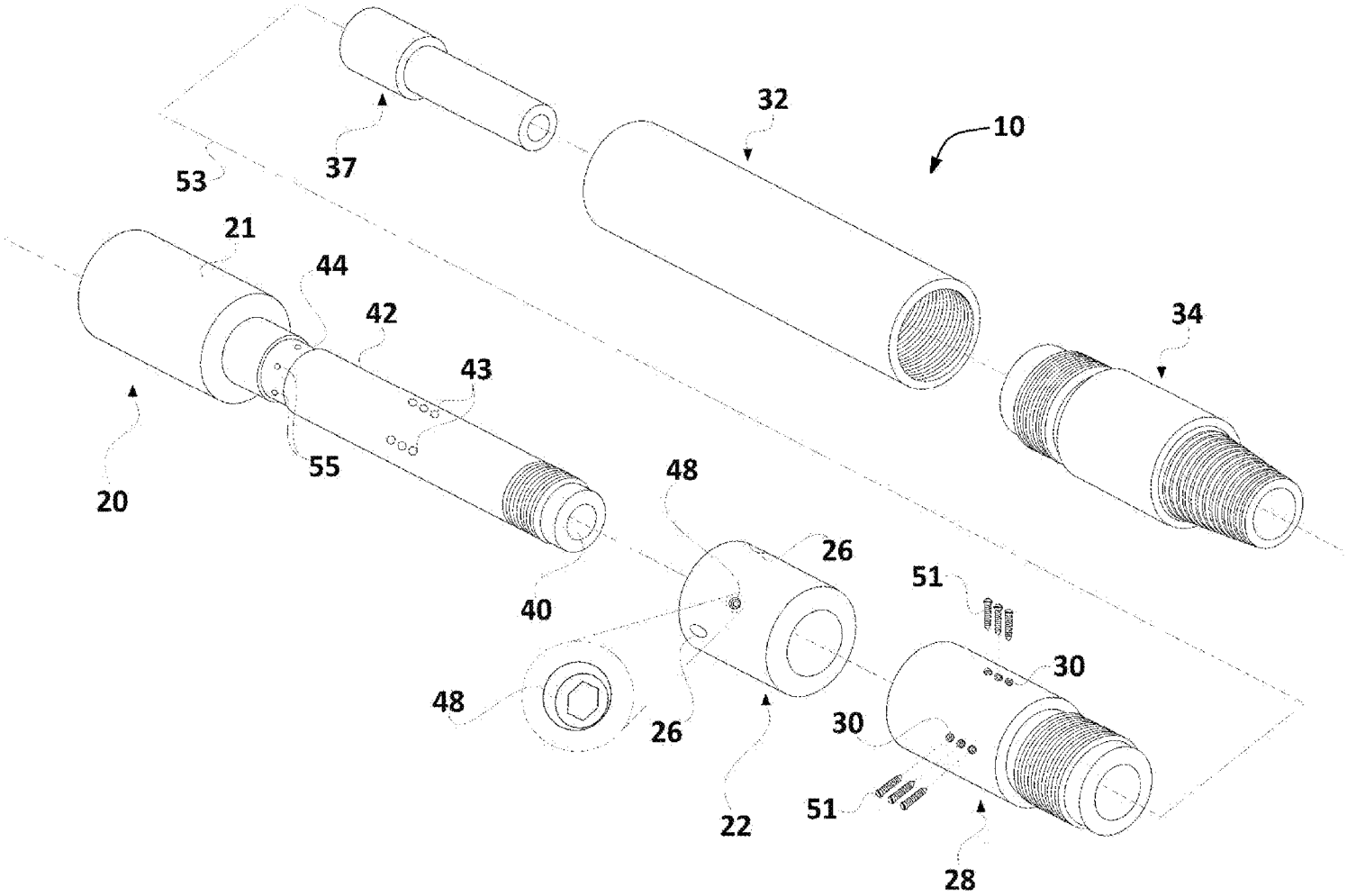
FIG. 1 is an exploded view of an embodiment of cleaning tool.
Figure 2B:
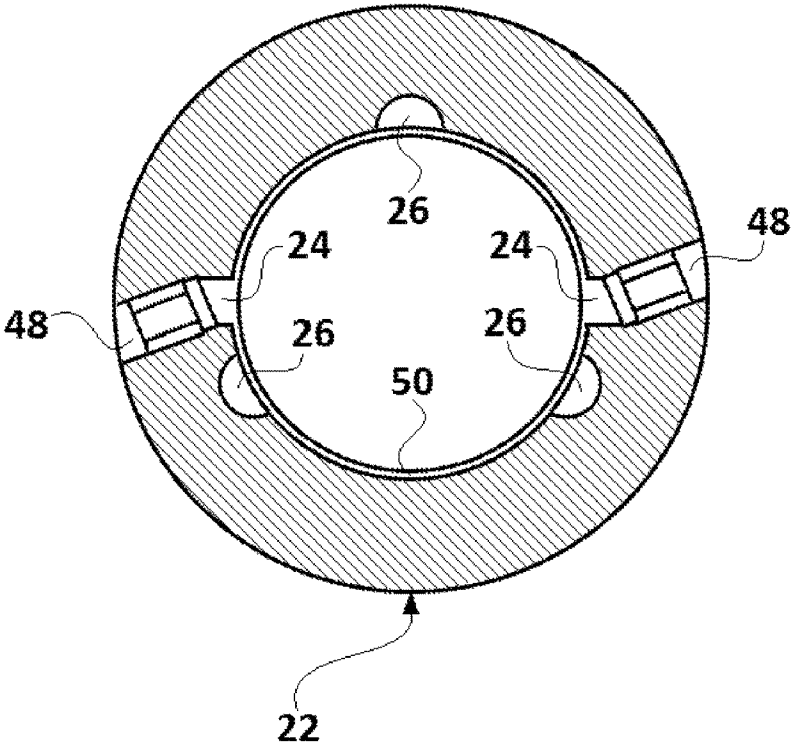
FIG. 2B is a cross-sectional view of the sleeve in FIG. 2A, taken along the lines A-A'.
Figure 2A:
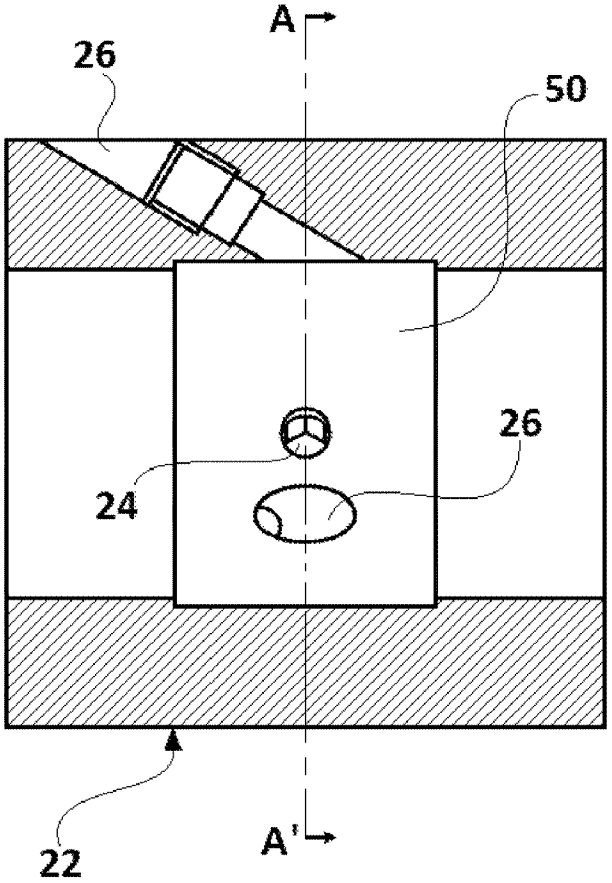
FIG. 2A is cross-sectional view of the sleeve in FIG. 1 along its longitudinal axis.
Figure 3:
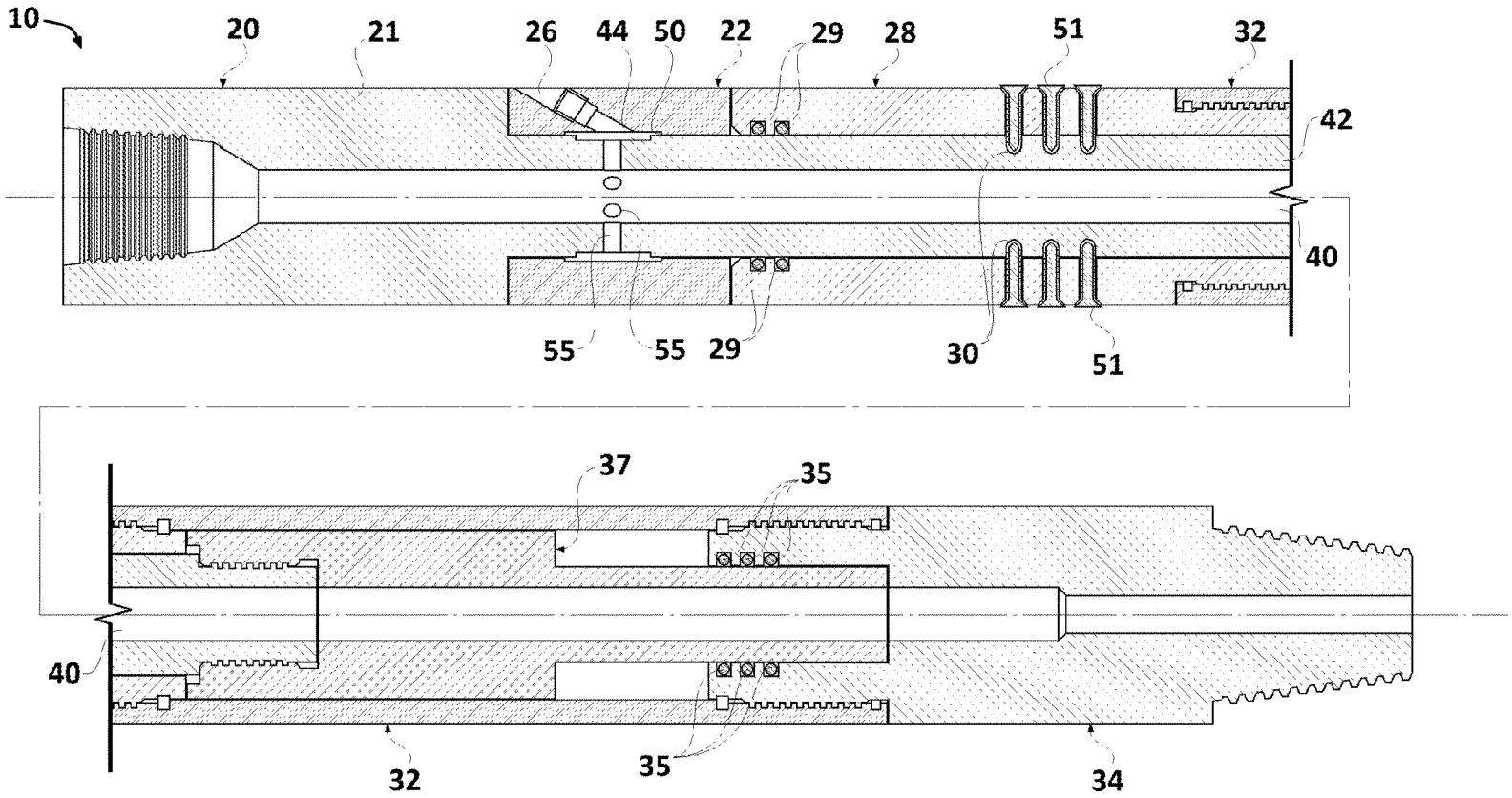
FIG. 3 is a cross-sectional view of the assembled tool of FIG. 1.

It should be understood that the drawings and the associated descriptions below are intended only to illustrate one or more embodiments of the present invention, and not to limit the scope of the invention. The drawings are not necessarily to scale.

DETAILED DESCRIPTION

Reference will now be made in detail to an embodiment of the cleaning tool with reference to the accompanying FIGS. 1-4. As illustrated in these figures, cleaning tool 10 comprises a mandrel 20 with an annular indentation 44 around its outer surface, with several holes 55 therein; more preferably, with six approximately equally spaced holes 55. Mandrel 20 further includes six sets (three dents per set) of dents 43 in lower portion 42, and a central bore 40. Sleeve 22 includes an annular indentation 50 on its interior surface.

Sleeve 22 slides over the lower portion 42 and rests against the edge of upper portion 21 of mandrel 20. When in position and drilling fluid is flowing into mandrel 20, sleeve 22 forms a metal to metal seal against the outer surface of mandrel 20 in areas other than the areas where annular indentation 50 overlies annular indentation 44 (wherein an annular gap is formed). It is preferable to have annular indentation 50 slightly wider than annular indentation 44, which more readily allows adjustable insert nozzles, preferably made of carbide, to be positioned in the inlets for tangential ports 24 and ejection ports 26, to either inhibit leakage and/or to establish different flow rates through different ports, in the several ports among tangential ports 24 and ejection ports 26.

Tangential ports 24 and ejection ports 26 of sleeve 22 have their inlets inside annular indentation 50, and these inlets can move into linear alignment with holes 55 when sleeve 22 is positioned on mandrel 20. Sleeve 22 can spin around mandrel 20, so the inlets move in and out of linear alignment with holes 55 during such rotation. The outlets of tangential ports 24 and ejection ports 26 (including outlet 48 of tangential ports 24) are on the exterior of sleeve 22.

Tangential ports 24 include a bent channel, which widens towards outlet 48, and where the channel bore is hexagonal in the area just inside the smooth-walled outlet 48 (enlarged in FIG. 1). As noted, other designs for tangential ports 24 which eject fluid at a sufficient tangent to spin sleeve 22 relative to mandrel 20 are also within the scope of the invention.

Ejection ports 26 also widen towards their outlet, and extend through the sides of sleeve 22 at an angle to the axis of sleeve 22. In the embodiment shown, there are three tangential ports 24 and three ejection ports 26, equally spaced along annular indentation 50. Other configurations and numbers of tangential ports 24 and ejection ports 26 are within the scope of the invention.

Figure 4:
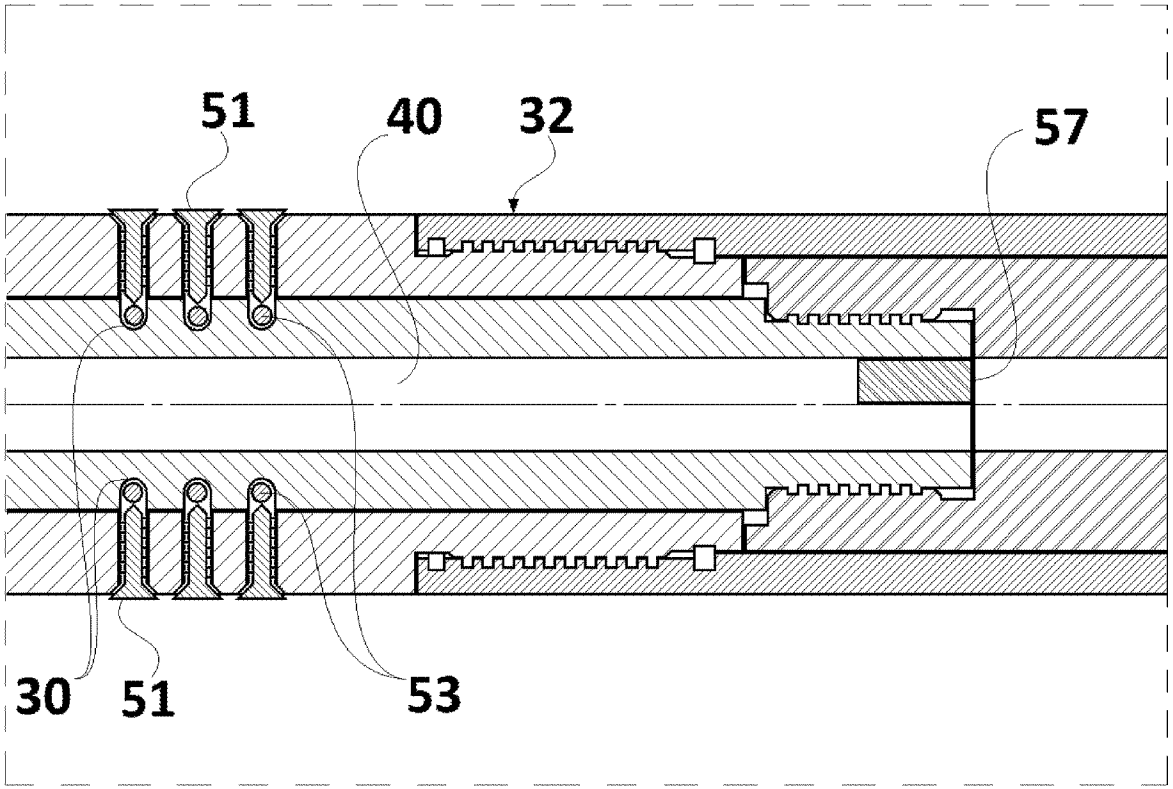
FIG. 4 is a view of the end of the mandrel in FIG. 1 showing an occlusion of the center bore at the lower end.

As seen in FIG. 4, mandrel 20 can optionally include a partial plug 57 to restrict flow past the outlet of its bore 40, and along the aligned bores of the wash pipe 37 and lower sub 34. Optionally, instead of partial plug 57, one can use a valve, which can selectively provide varying degrees of blockage to the outlet of bore 40. Specific dimensions and configurations of each of the holes 55 and 46, and each of the tangential ports 24 and ejection ports 26 control the volume per unit time and the pressure of the fluid exiting the ejection ports 26 (which aids in carrying off debris) and concomitantly control the pressure of the fluid in bore 40. The dimensions and configurations of each of the holes 55 and 46, and each of the tangential ports 24 and ejection ports 26 can be adjusted to optimize both tool 10 operation and protection of the BHA. Where a partial plug 57 or a valve is included in tool 10, the degree of blockage the exert in bore 40 can also be adjusted to optimize both tool 10 operation and protection of the BHA.

In operation, drilling fluid pumped from the surface through coiled tubing enters into upper end 21 of mandrel 20, which is attached to the coiled tubing using connectors/adapters with external threads matching the internal threads of upper end 21. Drilling fluid from the central bore 40 also flows through holes 55, and then enters tangential ports 24 and ejection ports 26. The ejection of the drilling fluid through tangential ports 24 to the exterior causes sleeve 22 to spin around mandrel 20. The ejection of the drilling fluid through the outlets of ejection ports 26, with the spin to sleeve 22 generated by fluid exiting ports 24, creates a spinning, upward facing vortex of drilling fluid, which carries with it debris generated by drilling, at the BHA (below tool 10).

Partial plug 57 helps protect the BHA, and especially its mud motor, from over-pressure. In order to power the mud motor and also provide additional pressure to operate tool 10, in a preferred operation, drilling fluid is pumped down at a greater rate than that needed to power the mud motor alone. Tool 10 uses the excess drilling fluid to power its operations. Partial plug 57 or a valving system diverts additional drilling fluid pressure to operate tool 10, and to help protect the mud motor.

The additional portions of tool 10 include an upper sub 28 which slides over lower portion 42 of mandrel 20 and rests against the lower edge of sleeve 22. When in position, each of holes 30 (preferably, six sets with three holes 30 per set) in upper sub 28 aligns with one of the dents 43. Screws 51 are threaded into holes 30, and their ends extend into dents 43, to fix upper sub 28 with respect to mandrel 20; or, preferably, balls 53 (FIG. 4) sized to fit, can be placed in the dents 43, and the screws 51 would then contact the upper side of the balls 53 to fix upper sub 28 with respect to mandrel 20, and prevent upper sub 28 from rotating with sleeve 22. Upper sub 28 preferably includes O-ring seals 29 between its upper inner surface, and the exterior surface of lower portion 42.

Wash pipe 37 screws to the lower end of mandrel 20, and has a bore aligning with central bore 40. The threaded portion of upper sub 28 screws into the upper end of barrel 32, and the upper threaded portion of lower sub 34 screws into the lower end of barrel 32. The lower end of lower sub 34 is attached (preferably through one or more of: tubing/connectors/adapters) to the BHA. Thus, in operation, drilling fluid entering the upper end of mandrel 20 flows along central bore 40 (some is diverted to holes 55 as noted above), and then through the wash pipe 37, and into the top central bore then out the lower end of lower sub 34. Lower sub 34 preferably includes O-ring seals 35 between its upper, inner surface, the exterior surface of wash pipe 37. Drilling fluid exiting the lower end of lower sub 34 is used to power the mud motor in the BHA.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described in the claims which follow, and not limited by any description elsewhere.

What is claimed is:

1. A circulating tool for removing debris from a well-bore, comprising:

a cylindrical mandrel with a central bore, a first annular indentation around its outer surface, and holes positioned in the first annular indentation running from the exterior to the central bore;

a cylindrical sleeve having an inner diameter designed to snugly accommodate the portion of the mandrel including the first annular indentation, wherein the sleeve includes a second annular indentation on its interior surface designed to align with the first annular indentation when the sleeve is positioned on the mandrel, the sleeve further including:

(i) tangential ports, which have their inlet opening positioned in the second annular indentation and have an outlet aligned to eject pressurized fluid from the central bore substantially at a tangent to the outer surface of the cylindrical sleeve, so as to cause the sleeve to spin about the mandrel; and (ii) ejection ports, which have their inlet opening positioned in the second annular indentation and have an outlet aligned to eject pressurized fluid from the central bore at an acute angle to the mandrel's longitudinal axis.

2. The circulating tool of claim 1 wherein the first and second annular indentations are the same width, or the first annular indentation is wider.

3. The circulating tool of claim 1 wherein there are three tangential ports and three ejection ports.

4. The circulating tool of claim 1 wherein the mandrel further includes a lower portion having a smaller outer diameter than an upper portion, and a shoulder separating the lower and upper portions, and wherein the sleeve slides over the lower portion and a first edge of the sleeve rests against the shoulder.

5. The circulating tool of claim 4 further including an upper sub which fits over the lower portion of the mandrel and rests against a second edge of the sleeve, and wherein the upper sub is fixed to the mandrel so that it cannot rotate around the mandrel.

6. The circulating tool of claim 5 wherein the upper sub includes holes which accommodate screws.

7. The circulating tool of claim 6 wherein the mandrel includes dents on its surface which accommodate balls, which are then contacted by the screws to fix the upper sub to the mandrel.

8. The circulating tool of claim 1 wherein the ejection ports and the tangential ports have outlets with a greater inner diameter than their inlets.

9. The circulating tool of claim 1 wherein the tangential ports have a six-sided channel between their inlet and outlet.

10. The circulating tool of claim 1 wherein the ejection ports' outlets direct fluid towards the upper portion of the mandrel.

11. The circulating tool of claim 1 wherein the second annular indentation is wider than the first annular indentation.

12. The circulating tool of claim 1 further including one or more adjustable insert nozzles positioned in at least one of the inlets for the tangential ports or the ejection ports.

13. The circulating tool of claim 12 wherein the adjustable insert nozzles are made of carbide.

14. A method of removing debris from a well-bore using a circulating tool, comprising:

a cylindrical sleeve having an inner diameter designed to snugly accommodate a cylindrical member carrying drilling fluid pumped down from the surface in its central bore, said cylindrical member including a first annular indentation around its outer surface, wherein the sleeve includes a second annular indentation on its interior surface designed to align with the first annular indentation when the sleeve is positioned on the member, the sleeve further including:

(i) tangential ports, which have their inlet opening positioned in the second annular indentation and have an outlet aligned to eject pressurized fluid from the central bore substantially at a tangent to the outer surface of the cylindrical sleeve, so as to cause the sleeve to spin about the member; and (ii) ejection ports, which have their inlet opening positioned in the second annular indentation and have an outlet aligned to eject pressurized fluid from the central bore at an acute angle to the member's longitudinal axis;

said method comprising:

connecting the circulating tool to a length of coil tubing upstream from the bottom-hole assembly, wherein the coiled tubing is wound around a drum;

reeling the coil tubing from the drum into the well-bore and commencing drilling, and wherein the sleeve spins around the member and the ejection ports shoot out a vortex of drilling fluid to carry away debris.

15. The method of claim 14, wherein said member is a mandrel with at least two portions having different outer diameters.

16. The method of claim 14, wherein the ejection ports' outlets direct fluid towards the upstream portion of the member.

17. The method of claim 14, wherein the second annular indentation is wider than the first annular indentation.

18. The method of claim 14, further including one or more adjustable insert nozzles positioned in at least one of the inlets for the tangential ports or the ejection ports.

19. The method of claim 18, wherein the adjustable insert nozzles are made of carbide.

20. The method of claim 15, wherein other portions of the circulating tool are fixed to the mandrel so that said other portions cannot rotate around the mandrel.

* * * * *